United States Patent [19]

Borkan

[11] 4,219,116

[45] Aug. 26, 1980

[54] CHILD-RESISTANT CONTAINER AND SAFETY CLOSURE THEREFOR

[75] Inventor: Florence Borkan, East Orange, N.J.

[73] Assignee: Pharmacaps, Inc., Elizabeth, N.J.

[21] Appl. No.: 16,106

[22] Filed: Feb. 28, 1979

[51] Int. Cl.[2] ..... B65D 43/16; B65D 55/02; B65D 45/18; B65D 1/22

[52] U.S. Cl. ..... 206/1.5; 220/306

[58] Field of Search ..... 206/1.5; 220/306

[56] References Cited

U.S. PATENT DOCUMENTS

| | | | |
|---|---|---|---|
| 976,165 | 11/1910 | Gray | 206/1.5 |
| 3,236,002 | 2/1966 | Cunningham et al. | 220/306 |
| 3,424,341 | 1/1969 | Slapnik | 220/306 |
| 3,825,110 | 7/1974 | Halbich et al. | 220/306 |
| 3,907,103 | 9/1975 | Shaw | 206/1.5 |
| 4,004,734 | 1/1977 | Hadtke | 220/306 |

*Primary Examiner*—William T. Dixson, Jr.
*Attorney, Agent, or Firm*—Kenyon & Kenyon

[57] ABSTRACT

A container and a child-resistant closure therefor are disclosed. The closure comprises two latches which require the simultaneous application of two forces to open the container. In the preferred embodiment, one latch is a snap latch and the other latch is a flex latch.

18 Claims, 6 Drawing Figures

CHILD-RESISTANT CONTAINER AND SAFETY CLOSURE THEREFOR

BACKGROUND OF THE INVENTION

The present invention relates to a safety closure for containers and the like and more particularly to a child-resistant safety closure for containers and the like.

SUMMARY OF THE INVENTION

It is an object of the present invention to provide a container which is resistant to opening by children.

It is another object of the present invention to provide a safety closure for containers and the like having hinged portions to make the container resistant to opening by children.

It is still another object of the present invention to provide a container which requires the coordinated application of two forces to open the container.

It is also an object of the present invention to provide a safety closure for containers and the like having hinged portions which require the coordinated application of two forces to open the container.

These and other objects of the invention are achieved by a container and a safety closure therefor in which the safety closure comprises two latches. One of the latches requires the application of one predetermined force to unlatch it and the other latch requires the application of another predetermined force to unlatch it. Thus, to unlatch both latches and open the container, the application of two coordinated forces is required. This coordinated application of forces makes the container essentially impossible to open by children who have not been shown how to open the container.

More specifically, the container according to the invention comprises a lower portion, an upper portion, hinge means hingedly connecting the upper and lower portions, and first and second latch means for latching the container closed. The first latch means are connected to the upper and lower container portions and are adapted to engage upon forcibly hinging the container closed. The second latch means include a member flexibly connected to one of the container portions and extending into the interior of the container when the container is hinged closed, a protrusion connected to the member or the other container portion and receptacle means therefor in the other container portion or the member, respectively. The member is adapted to be flexed to engage the protrusion and the receptacle upon forcibly hinging the container closed.

Means are provided on the exterior of each of the container portions for applying a first force to disengage the first latch means when the container is hinged closed, and an opening is provided in one of the container portions for providing access to the first member for flexing it to disengage the protrusion and receptacle means upon the application of a second force to the member when the container is hinged closed. The container is opened from a hinged closed configuration by the simultaneous application of the first force to disengage the first latch means and the second force to flex the member to disengage the second latch means.

In the preferred embodiment, the first latch means comprises a protrusion on one of the container portions and a receptacle in the form of a recess on the other container portion, the protrusion and receptacle of the first latch means being positioned and sized to provide a snap fit thereof where the container is forcibly hinged closed thereby engaging the first latch means. The means on the exterior of each of the container portions comprises a flange. The protrusion of the first latch means is connected to one of the flanges and the receptacle of the first latch means is an indentation formed by a pair of spaced projections on the exterior of the container adjacent the protrusion on the one flange in the hinged closed configuration of the container. The protrusion on the one flange is snap-fitted and engaged in the indentation in the hinged closed configuration of the container.

Also in the preferred embodiment, the protrusion of the second latch means is an elongated shoulder on the member and the receptacle of the second latch means is an elongated recess on the other container portion. The opening is aligned with the recess and provides access to the shoulder of the member when it is received in the recess, the shoulder of the member being contacted to flex the member to disengage the shoulder and recess.

Each of the flanges is adapted to being contacted to apply the first force to separate the container portions. Thus, three contacts and the coordinated application of two forces are required to unlatch the safety closure and open the container.

These and other aspects of the invention will be more apparent from the following description of the preferred embodiments thereof when considered with the accompanying drawings and appended claims.

BRIEF DESCRIPTION OF THE DRAWINGS

The present invention is illustrated by way of example and not limitation in the figures of the accompanying drawings in which like references indicate similar parts and in which:

FIG. 6 is a perspective view of a container according to another embodiment of the invention.

DESCRIPTION OF THE PREFERRED EMBODIMENTS

Figure 1:
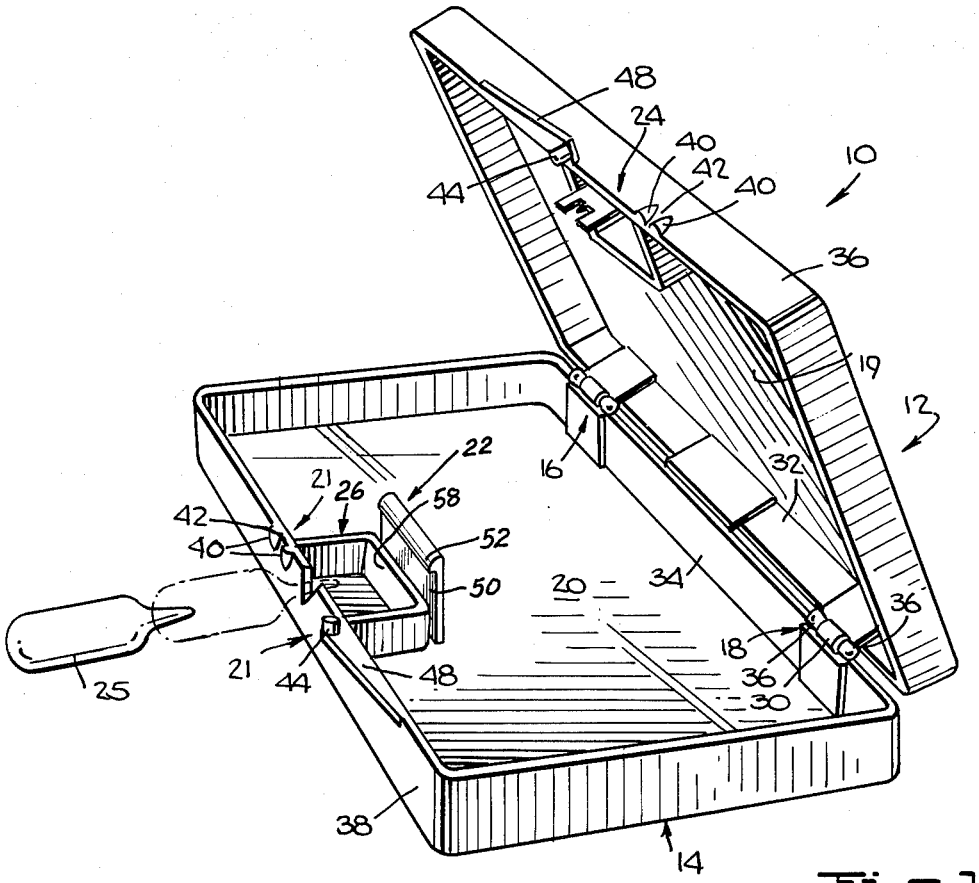
FIG. 1 is a perspective view of the container and safety closure according to the invention with the container being partially opened.

Referring now more particularly to the drawings, a container which is resistant to opening by children and a safety closure therefor are illustrated. In FIG. 1, the container is referenced generally by 10 and comprises a top 12 and a bottom 14 which are hinged together by hinges 16 and 18. The top and bottom each are unitary pieces molded from plastic material and are defined by four sidewalls extending from a top end 19 and a bottom end 20, respectively. Snap latches 21 and a flex latch 22 are provided to latch the container closed.

As illustrated in FIGS. 1–5, the container 10 is provided with a cutter referenced generally by 24 which is used to cut gelatin capsules 25 upon closure of the container. An internal compartment 26 is provided for receiving the cut portion of the capsule. The cutter 24 and the internal compartment 26 and the operation thereof for cutting capsules are described more particularly in co-pending Application Ser. No. 879,858 filed on Feb. 22, 1978, now U.S. Pat. No. 4,159,568 in the name of Howard E. Berner and assigned to the assignee of this application. U.S. Pat. No. 4,159,568 is hereby incorporated by reference.

Each hinge, 16, 18 is formed by a somewhat tubular protrusion 30 located on opposed, rear sidewalls 32, 34 of the top and bottom of the container snap fitted between a pair of spaced spherical protrusions 36 located on the respective rear sidewall opposed to that on which tubular protrusion is disposed. The ends of the plastic tubular protrusions are planar and are engaged by the plastic spherical protrusions to form the hinges.

The snap latches 21 are located on the front sidewalls 36, 38 of the top and bottom of the container adjacent cutter 24. Each latch 21 comprises a pair of spaced projections 40 which form an indentation 42 therebetween along the outside of the respective front sidewall and a protrusion 44 on a respective flange 48 extending outwardly from the respective front sidewall of the top and bottom of the container. Each protrusion 44 is located so that it will be intermediate the projections 40 when the container is hinged closed, the protrusions 44 being snapped into the indentations 42 and engaged by the projections 40. To disengage or unsnap the protrusions 44 from the indentations 42, each flange 48 is contacted and a force is applied to the flanges to separate them. This force acts to unsnap the protrusions 44 from the indentations 42 and open the container in conjunction with the unlatching of flex latch 22 described below.

Figure 2:
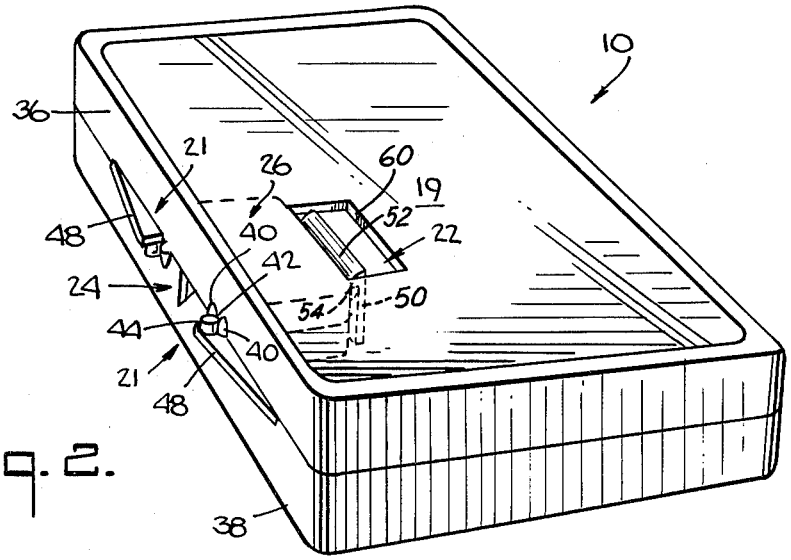
FIG. 2 is a perspective view of the container of FIG. 1 with the container in the hinged closed configuration.
Figure 3:
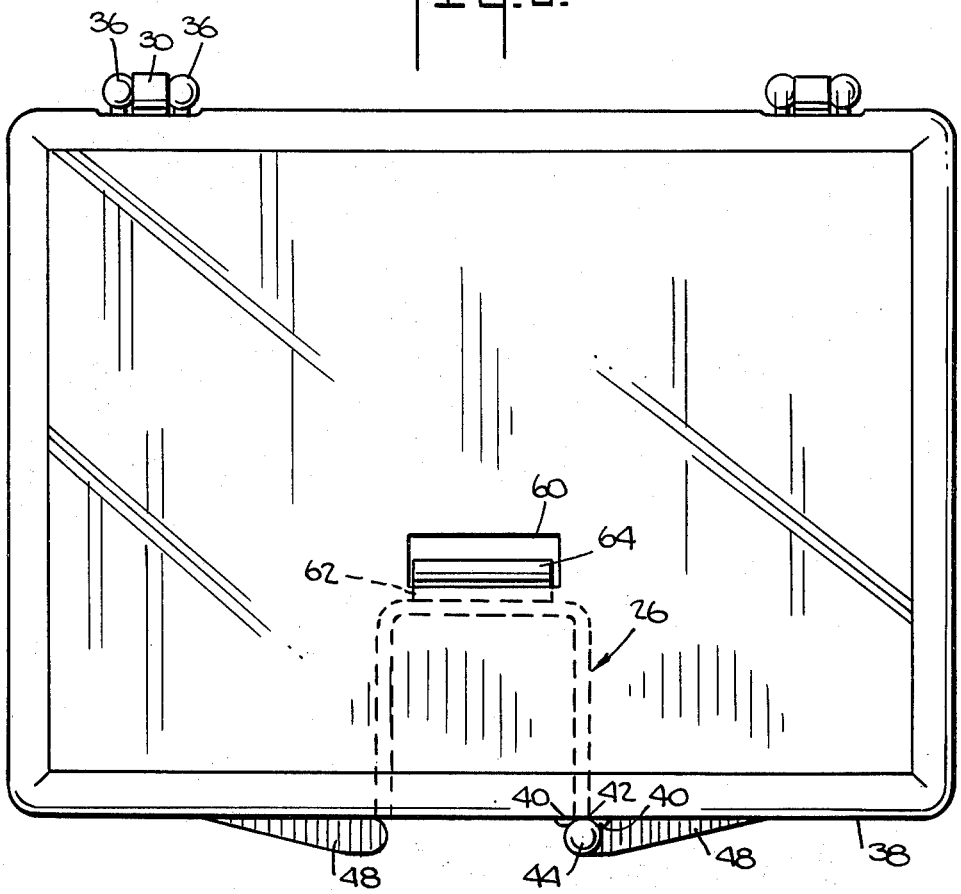
FIG. 3 is a top view of the container of FIG. 1 in the hinged closed configuration of the container.
Figure 4:
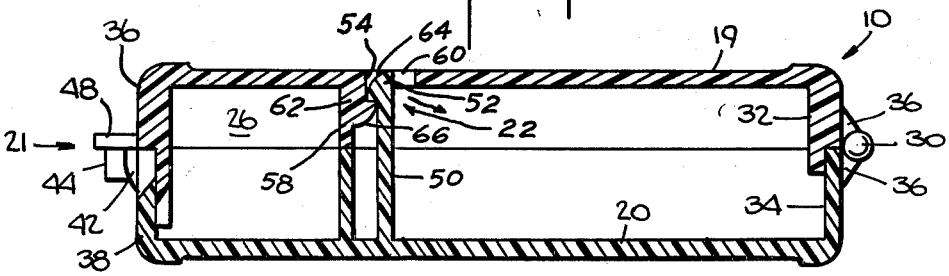
FIG. 4 is a section view taken along lines 4—4 of FIG. 2.
Figure 5:
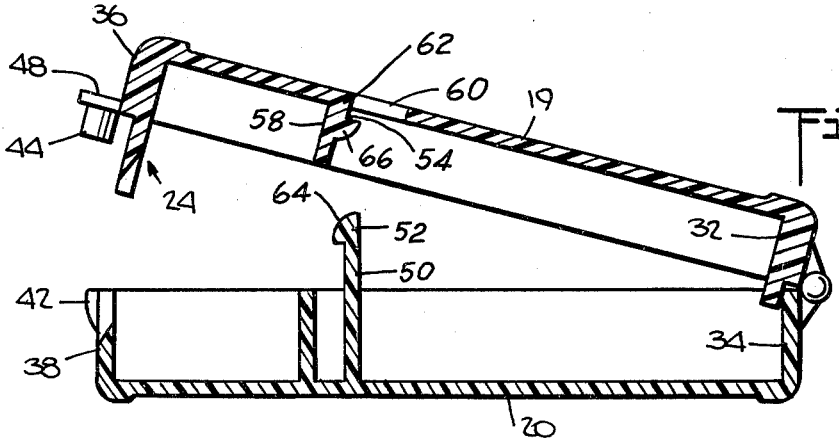
FIG. 5 is a section view similar to the view in FIG. 4 in the hinged open configuration of the container.
Figure 8:
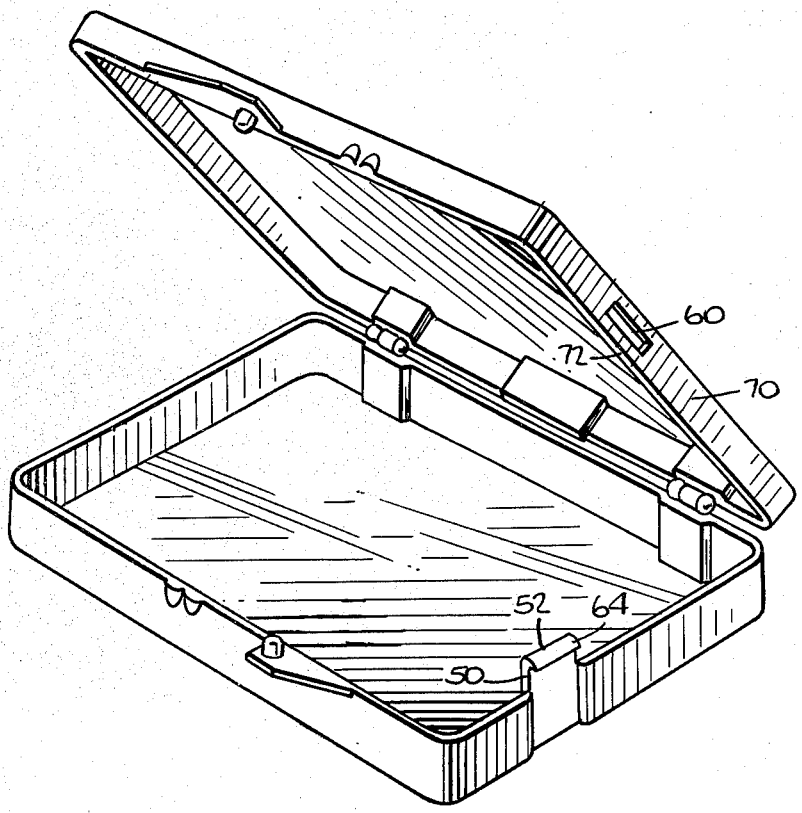

Flex latch 22 comprises an elongated member 50 flexibly connected to the bottom end 20 of the container. Member 50 extends into the container interior when the container is hinged closed as shown in FIGS. 2 and 4. A protrusion in the form of a shoulder 52 is disposed at the free end of member 50. The length of the member 50 including shoulder 52 is less than the enclosed height of the container and the thickness of the top end 19 of the container so that the shoulder 52 will not protrude through the top of the container when the container is hinged closed (FIG. 4). Latch 22 also includes a receptacle in the form of a recess 54 adjacent to the top of the container on a wall 58 of the internal compartment 26. The recess is co-extensive with the length of the shoulder 52. An opening 60 is provided in the top end 19 of the container in alignment with recess 54 so that the recess is accessible from the exterior of the container. The recess is formed from a cutaway portion of a member 62 connected to the wall 58 of compartment 26. The recess is sized to receive shoulder 52 therein such that the exposed end of the shoulder 52 as shown in FIG. 4 is flush with the top end 19 of the container. Both the shoulder 52 and the member 62 in which the recess 54 is formed include arcuate or inclined surfaces 64, 66 which cooperate to flex the member 50 as the container is hinged closed, the surfaces slidingly contacting each other. Thus, these surfaces 64, 66 act as cams to flex member 50 toward the rear sidewalls 32, 34 of the container away from member 62 as the container is hinged closed. Once the shoulder 52 clears surface 66 of member 62, the member 50 flexes back to its normal unflexed position and will be received in recess 54 to engage latch 22 (FIG. 4).

To disengage latch 22, member 50 must be flexed toward the rear sidewalls 32, 34 of the container to disengage shoulder 52 from recess 54 and the container top and bottom separated. This may be accomplished by placing one's finger on the exposed portion of the shoulder 52 in opening 60 and pressing the shoulder 52 toward the rear sidewalls of the container to flex member 50 and disengage the shoulder 52 from the recess 54. At the same time, the force is applied to the flanges to separate the container top and bottom.

To latch the container closed, it is merely necessary to hinge the container closed with sufficient force to snap fit the protrusions 44 of the snap latches 21 into the indentations 40 and to cam surface 64 of shoulder 52 over surface 66 until the shoulder is received in the recess 54.

To open the container it is necessary to simultaneously apply two coordinated forces. As described above, one force is applied to separate the flanges 48 to both unsnap the snap latches 21 and to move the flexed and disengaged member 50 away from the recess 54. This force may be applied by using different fingers of one hand. The second force to flex member 50 toward the rear sidewalls of the container may be applied, as mentioned, by another finger. Since the two forces must be applied simultaneously, it is necessary to use two hands to open the container with any facility. The container may be grasped with one hand and two fingers of the other hand used to apply the separating force to the flanges. At the same time, one finger of the hand grasping the container is used to flex member 50. Some coordination is thus required to use both hands and simultaneously apply the two forces. This coordination is not normally possessed by children unless they have been repeatedly shown how to apply the forces to open the container.

Member 50, shoulder 52, member 62 and recess 54 are so disposed as shown in FIGS. 1–5 so as not to interfere with the cutting action of blade 24. Thus, the camming action of the surfaces 64, 66 of the flex latch do not act to separate the portions of blade 24 connected to the top and bottom of the container during cutting.

Referring now to FIG. 6, another embodiment of the flex latch is illustrated. In FIG. 6 member 50 and shoulder 52 are connected to a sidewall of the container bottom and the recess is disposed in a sidewall of the container top. The recess is formed by opening 60 in the sidewall 70 of the container top. The camming surface 64 is provided on the shoulder 52 of member 50 and cooperates with the edge 72 of the sidewall 70 of the container top to flex the member 50 to the left in FIG. 6 when the container is being hinged closed. When the shoulder 52 is adjacent the opening 60 in the sidewall 70, the member 50 will flex back to the right to engage the shoulder in the opening 60. The shoulder 52 of member 50 is flush with the exterior surface of the sidewall 70 of the container top when the container is hinged closed. To disengage the shoulder from the opening 60, it is necessary to contact the shoulder 52 in the opening 60 to flex member 50 to the left. The container is otherwise opened as described for FIGS. 1–5 with the simultaneous application of the separating force to flanges 44 and pressing shoulder 52 in the opening 60 to the left.

As mentioned, the container top 12 and bottom 14 each are unitary pieces made of plastic material, i.e., parts of the blade, hinges, snap latches, flanges, flex latch and compartment form a unitary structure with the respective container top or bottom. The top and bottom may be integrally formed with the respective parts of the blade, hinges, snap latches, flanges, flex latch and compartment by, for example, a molding process.

The advantages of the present invention as well as certain changes and modifications of the disclosed embodiments thereof, will be readily apparent to those skilled in the art. For example, while the embodiment in FIGS. 1–5 has been illustrated as including a cutter for capsules, it is understood that the safety closure according to the invention may be used in many different types of containers as illustrated, for example, in FIG. 6. Additionally, it is to be further understood that the positions of member 50, the recess 54 and opening 60 may vary. It is the applicant's intention to cover by her claims all those changes and modifications which can be made to the embodiments of the invention herein chosen for the purpose of the disclosure without departing from the spirit and scope of the invention. Protection by Letters Patent of this invention and all its aspects as the same are set forth in the appended claims is sought to the broadest extent that the prior art allows.

What is claimed is:

1. A container comprising a lower portion, an upper portion, hinge means hingedly connecting the upper and lower portions, first latch means connected to the upper and lower container portions adapted to engage upon hinging the container closed, second latch means including a member flexibly connected to one of the container portions and extending into the interior of the container when the container is hinged closed, a protrusion associated with one of the member and the other container portion and receptacle means for the protrusion associated with the other of the member and container portion, said protrusion and said receptacle being disposed within exterior surfaces of the container when the container is hinged closed, the member being adapted to be flexed to engage the protrusion and the receptacle upon hinging the container closed, means on the exterior or each of the container portions for applying a first force for disengaging the first latch means when the container is hinged closed, an opening in one of the container portions for providing access to the member for flexing it for disengaging the protrusion and receptacle means upon the application of a second force to the member when the container is hinged closed, the container being adapted to be opened from a hinged closed configuration by the simultaneous application of the first force for disengaging the first latch means and the second force for flexing the member for disengaging the second latch means.

2. The container as recited in claim 1, wherein the first latch means comprises a protrusion on one of the container portions and a receptacle on the other of the container portions, the protrusion and receptacle of the first latch means being positioned and sized to provide a snap fit thereof where the container is forcibly hinged closed thereby engaging the first latch means.

3. The container as recited in claims 1 or 2, wherein the protrusion of the second latch means is an elongated shoulder on said member and the receptacle means of the second latch means is an elongated recess associated with the other container portion.

4. The container as recited in claim 3, wherein the opening is aligned with the recess of the second latch means and is adapted to provide access to the shoulder on the member when the shoulder is engaged in the recess, the shoulder on the member being adapted to be contacted from outside the container to flex the member.

5. The container as recited in claim 4, wherein said means on the exterior of each of the container portions comprises a flange, said flanges being generally adjacently disposed and each flange being adapted to be contacted to apply the first force to the container in a direction to separate the container portions.

6. The container as recited in claim 5, wherein the protrusion of the first latch means is connected to one of the flanges and the receptacle of the first latch means comprises a pair of spaced projections forming an indentation therebetween on the exterior of the container opposite the protrusion on the one flange in the hinged closed configuration of the container, the protrusion on the one flange being adapted to be snap fitted and engaged in the indentation in the hinged closed configuration of the container.

7. The container as recited in claim 4, wherein the member extends from the lower container portion and the recess is associated with the upper container portion.

8. The container as recited in claim 7, wherein the recess is connected to another member which is connected to the upper container portion and extends into the interior of the container.

9. The container as recited in claim 4, wherein the recess is the opening and is positioned in a sidewall of the container.

10. A container comprising a lower portion, an upper portion, hinge means hingedly connecting the upper and lower portions, first latch means connected to the upper and lower container portions adapted to engage upon hinging the container closed, second latch means including a member flexibly connected to one of the container portions and extending into the interior of the container when the container is hinged closed, a protrusion associated with one of the member and the other container portion and receptacle means for the protrusion associated with the other of the member and container portion, said protrusion and said receptacle being disposed within exterior surfaces of the container when the container is hinged closed, the member being adapted to be flexed to engage the protrusion and the receptacle upon hinging the container closed, a flange disposed on the exterior of each of the container portions and extending therefrom, said flanges being generally adjacently disposed and adapted to be contacted for applying a first force in a direction to separate container portions and for disengaging the first latch means when the container is hinged closed, an opening in one of the container portions for providing access to the member for flexing it for disengaging the protrusion and receptacle means upon the application of a second force to the member when the container is hinged closed, the container being adapted to be opened from a hinged closed configuration by the simultaneous application of the first force for disengaging the first latch means and the second force for flexing the member for disengaging the second latch means.

11. A container of generally solid rectangular exterior shape comprising a lower portion and an upper portion, said upper and lower portions having generally smooth exterior surfaces, said container further comprising hinge means hingedly connecting the upper and lower portions, first latch means connected to the upper and lower container portions adapted to engage upon hinging the container closed, second latch means including a member flexibly connected to one of the container portions and extending into the interior of the container when the container is hinged closed, a protrusion associated with one of the member and the other container portion and receptacle means for the protrusion associated with the other of the member and container portion, said protrusion and said receptacle being disposed within exterior surfaces of the container when the container is hinged closed, the member being adapted to be flexed to engage the protrusion and the receptacle upon hinging the container closed, a flange disposed on the exterior of each of the container portions and extending therefrom, said flanges being generally adjacently disposed and adapted to be contacted for applying a first force in a direction to separate container portions and for disengaging the first latch means when the container is hinged closed, an opening in one of the container portions for providing access to the member for flexing it for disengaging the protrusion and receptacle means upon the application of a second force to the member when the container is hinged closed, the container being adapted to be opened from a hinged closed configuration by the simultaneous application of the first force for disengaging the first latch means and the second force for flexing the member for disengaging the second latch means.

12. The container as recited in claims 10 or 11, wherein the first latch means comprises a protrusion on one of the container portions and a receptacle on the other of the container portions, the protrusion and receptacle of the first latch means being positioned and sized to provide a snap fit thereof where the container is forcibly hinged closed thereby engaging the first latch means.

13. The container as recited in claims 10 or 11, wherein the protrusion of the second latch means is an elongated shoulder on said member and the receptacle means of the second latch means is an elongated recess associated with the other container portion.

14. The container as recited in claim 13, wherein the opening is aligned with the recess of the second latch means and is adapted to provide access to the shoulder on the member when the shoulder is engaged in the recess, the shoulder on the member being adapted to be contacted from outside the container to flex the member.

15. The container as recited in claim 13, wherein the protrusion of the first latch means is connected to one of the flanges and the receptacle of the first latch means comprises a pair of spaced projections forming an indentation therebetween on the exterior of the container opposite the protrusion on the one flange in the hinged closed configuration of the container, the protrusion on the one flange being adapted to be snap fitted and engaged in the indentation in the hinged closed configuration of the container.

16. The container as recited in claim 14, wherein the member extends from the lower container portion and the recess is associated with the upper container portion.

17. The container as recited in claim 16, wherein the recess is connected to another member extending into the interior of the container from the upper container portion.

18. The container as recited in claim 14, wherein the recess is the opening and is positioned in a sidewall of the container.

* * * * *